US005708994A

United States Patent [19]

Chandran

[11] Patent Number: 5,708,994

[45] Date of Patent: Jan. 20, 1998

[54] OPEN TOP FOLDABLE CRADLE

[76] Inventor: Krishna Chandran, 740 Fairborn Rd., Cincinnati, Ohio 45240

[21] Appl. No.: 598,377

[22] Filed: May 13, 1996

[51] Int. Cl.[6] ..... A47D 9/00

[52] U.S. Cl. ..... 5/102; 5/103; 5/127

[58] Field of Search ..... 5/98.3, 101, 102, 5/103, 124, 127

[56] References Cited

U.S. PATENT DOCUMENTS

| | | | |
|---|---|---|---|
| 523,337 | 7/1894 | Ebert | 5/101 |
| 4,375,110 | 3/1983 | Murphy | 5/98.3 |
| 4,550,456 | 11/1985 | Allen | 5/98.3 |
| 5,095,563 | 3/1992 | Miller | 5/101 |
| 5,511,258 | 4/1996 | Barr, Sr. | 5/101 |

FOREIGN PATENT DOCUMENTS

| | | | |
|---|---|---|---|
| 444473 | 3/1936 | United Kingdom | 5/101 |

*Primary Examiner*—Michael F. Trettel
*Attorney, Agent, or Firm*—Steven J. Rosen

[57] ABSTRACT

A foldable cradle assembly includes a cradle made of a flexible material, a foldable frame supporting the cradle, and an attachment device for attaching the cradle to the frame such that the flexible material hangs down freely from an open top of the cradle. Four lines may be attached to four spaced apart corners of the cradle at the first line ends. A first two of the lines at a first cradle end of the cradle may be attached to a first position on the frame and a second two of the lines at a second cradle end of the cradle may be attached to a second position on the frame such that the first and second positions are spaced apart a distance greater than a cradle length of the cradle. Spreading bars for holding the top of the cradle spread open may be disposed between each of the two lines attached to each of the cradle ends. The cradle may have a spread out rectangular shape and the lines may be strings, ropes, or chains. Frame end sections include vertical legs pivotally attached to the base frame section such that the two C shaped frame end sections are pivotally connected to the base frame at an opposite frame ends. The frame also may have first and second frame side members with hinged side sections that are pivotal through only 180 degrees with respect to each other. The frame preferably includes side members that have telescopic means for adjusting a frame length of the side members and frame end sections that have telescopic means for adjusting leg lengths of vertical legs.

17 Claims, 2 Drawing Sheets

OPEN TOP FOLDABLE CRADLE

BACKGROUND OF THE INVENTION

Field of the Invention

This invention relates to a foldable frame and cradle assembly and in particular to such an assembly with a cradle with a free hanging cloth material body support attached to a foldable frame.

SUMMARY OF THE INVENTION

A foldable cradle assembly includes a cradle made of a flexible material, a foldable frame supporting the cradle, and an attachment device for attaching the cradle to the frame such that the flexible material hangs down freely from an open top of the cradle. The attachment device may be lines having first line ends attached to the cradle and second line ends attached to the frame and may include a ring loosely attached to the frame. Four lines may be attached to four spaced apart corners of the cradle at the first line ends. A first two of the lines at a first cradle end of the cradle may be attached to a first position on the frame and a second two of the lines at a second cradle end of the cradle may be attached to a second position on the frame such that the first and second positions are spaced apart a distance greater than a cradle length of the cradle. Spreading bars for holding the top of the cradle spread open may be disposed between each of the two lines attached to each of the cradle ends. The cradle may have a spread out rectangular shape and the lines may be strings, ropes, or chains.

In a preferred embodiment of the invention, the frame has a rectangular base frame section with spaced apart first and second frame side members fixedly attached at opposite frame ends of the frame to first and second end members of the base frame. Each of two C shaped frame end sections include vertical legs pivotally attached to the base frame section such that the two C shaped frame end sections are pivotally connected to the base frame at an opposite frame ends. The frame also has attachment devices to support the cradle from width wise extending cross members of the frame end sections. The first and second frame side members preferably have hinged side sections that are pivotal through only 180 degrees with respect to each other. The frame further includes two C shaped bracing members, each of which is pivotally attached to one of the two frame side members and the two end sections and removably secured by a securing device to the other of the two frame side members and the two end sections. The securing device may incorporate a screw for securing.

The frame preferably includes side members that have telescopic means for adjusting a frame length of the side members and frame end sections have telescopic means for adjusting leg lengths of the vertical legs.

ADVANTAGES OF THE INVENTION

The present invention has several advantageous features including a soft sided or freely hanging cradle that will form a "boat" or "U" shape to accommodate the baby yet still provide an open top for easy accessibility. The cradle and frame assembly of the present invention can be easily folded into a compact structure to provide easy storage and a space savings. The frame has telescopic joints for adjusting the height and the length of the frame. The removable cradle is made of a material for easy cleaning and replacement. The cradle and frame assembly of the present invention is light weight for easy handling and transportation and has swivel wheels for easy moving of the unfolded assembly.

The novel features of the present invention, together with its further objectives and advantages, is demonstrated by reference to the detailed description and drawings of the invention. However, the drawings are for purposes of illustration and description only and, not intended to define the limits or boundaries of the invention.

BRIEF DESCRIPTION OF THE DRAWINGS

The foregoing aspects and other features of the invention are explained in the following description, taken in connection with the accompanying drawings where.

Figure 1:
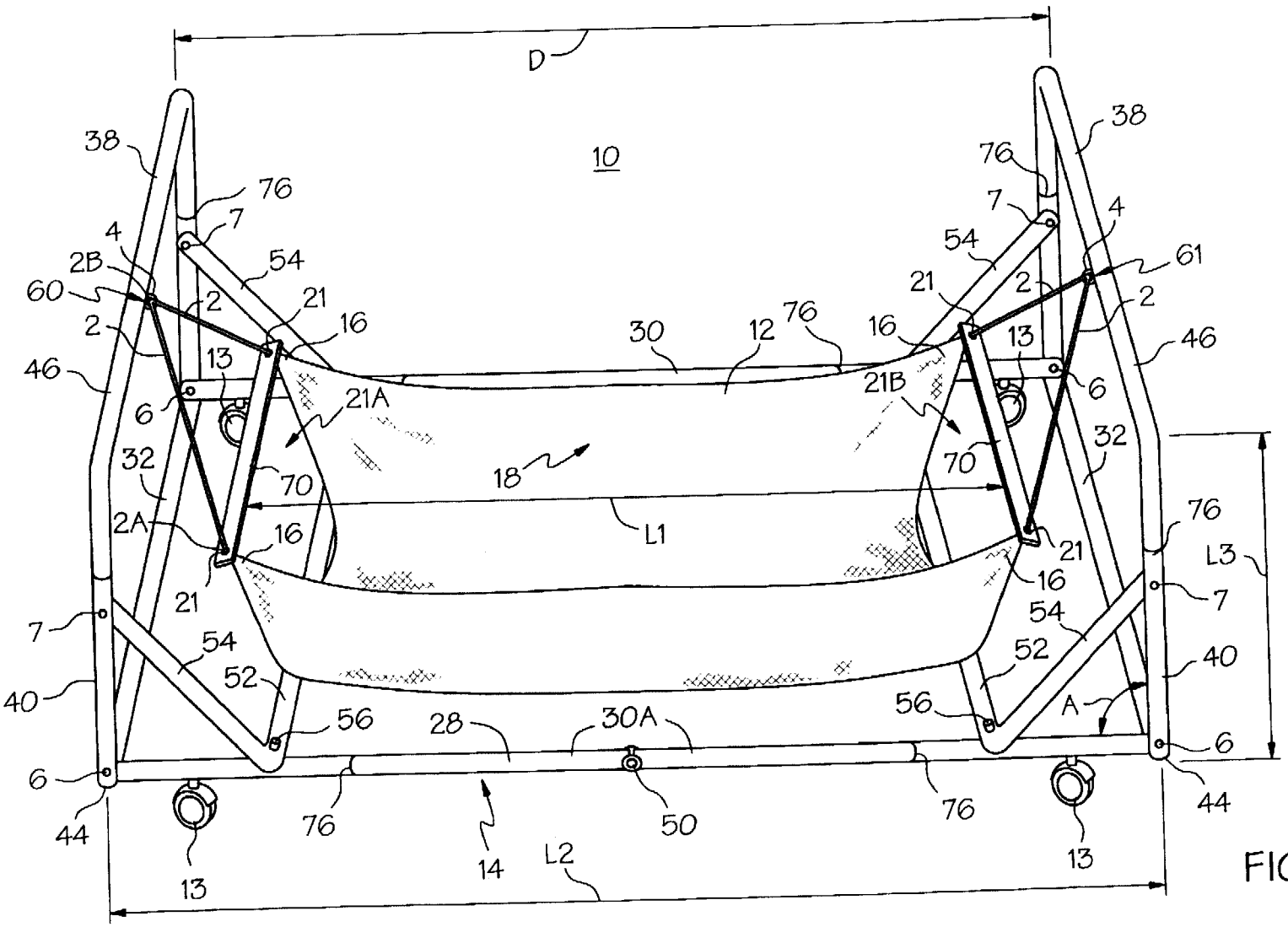
FIG. 1 is a perspective view of a "U" shaped foldable cradle and frame assembly in accordance with a first exemplary embodiment of the present invention.

In describing the preferred embodiment of the invention illustrated in the drawing, specific terminology will be resorted to for sake of clarity. However, it is not intended to be limited to the specific terms so selected and it is to be understood that each specific term includes all technical equivalents which operate in a similar manner to accomplish a similar purpose.

DETAILED DESCRIPTION OF THE INVENTION

Referring to FIG. 1, there is shown an exemplary embodiment of the present invention, a foldable cradle and frame assembly 10 having a "U" shaped cradle 12 made of a flexible material and a foldable frame 14 supporting the cradle. An attachment means, illustrated as including a hanging ring 4 attached to the frame is used for attaching the cradle 12 to the frame 14 such that the flexible material of the cradle hangs down freely from an open top 18 of the cradle. The attachment means further includes four lines 2 which are tied in pairs to corners 16 at opposite first and second cradle ends 21A and 21B, respectively, of the cradle 12. Each of the lines 2 has a first line end 2A attached to one of the corners 16 and a second line end 2B attached to the ring 4 on frame 14. Four lines 2 may be attached to four spaced apart corners 16 of the cradle 12 at the first line ends or each of two cords may be attached to two corners 16 at each of the cradle ends 21A and 21B and each cord passes through ring 4.

The frame 14 has a rectangular base frame section 28 with spaced apart first and second frame side members 30 fixedly attached at opposite frame ends of the frame to first and second end members 32 of the base frame. Each of two C shaped frame end sections 38 include vertical legs 40 pivotally attached to the base frame section 28 by a hinge joint 6 such that the two C shaped frame end sections are pivotally connected to the base frame at an opposite frame ends 44. The frame 14 also has the attachment means, or rings 4 used to support the cradle 12, mounted on width wise extending cross members 46 of the frame end sections 38. The first and second frame side members 30 preferably have hinged side sections 30A connected by an elbow joint 50 so that they are pivotal through only 180 degrees with respect to each other. The frame further includes two C shaped bracing members 52 having bracing legs 54, each of which is pivotally attached to the two end sections 38 by a hinged joint 7 and removably secured by a securing means 56 to the two frame side members 30. Alternatively (not shown), the bracing legs 54 may be pivotally attached to the two frame side members 30 by the hinged joint 7 and removably secured by the securing means 56 to the two end sections 38. The securing means 56 may incorporate a screw for securing. The bracing members 52 can be secured at different points on the base frame section 28 so that the angle of tilt A between the first and second end sections 38 and the base frame section can be adjusted.

Figure 2:
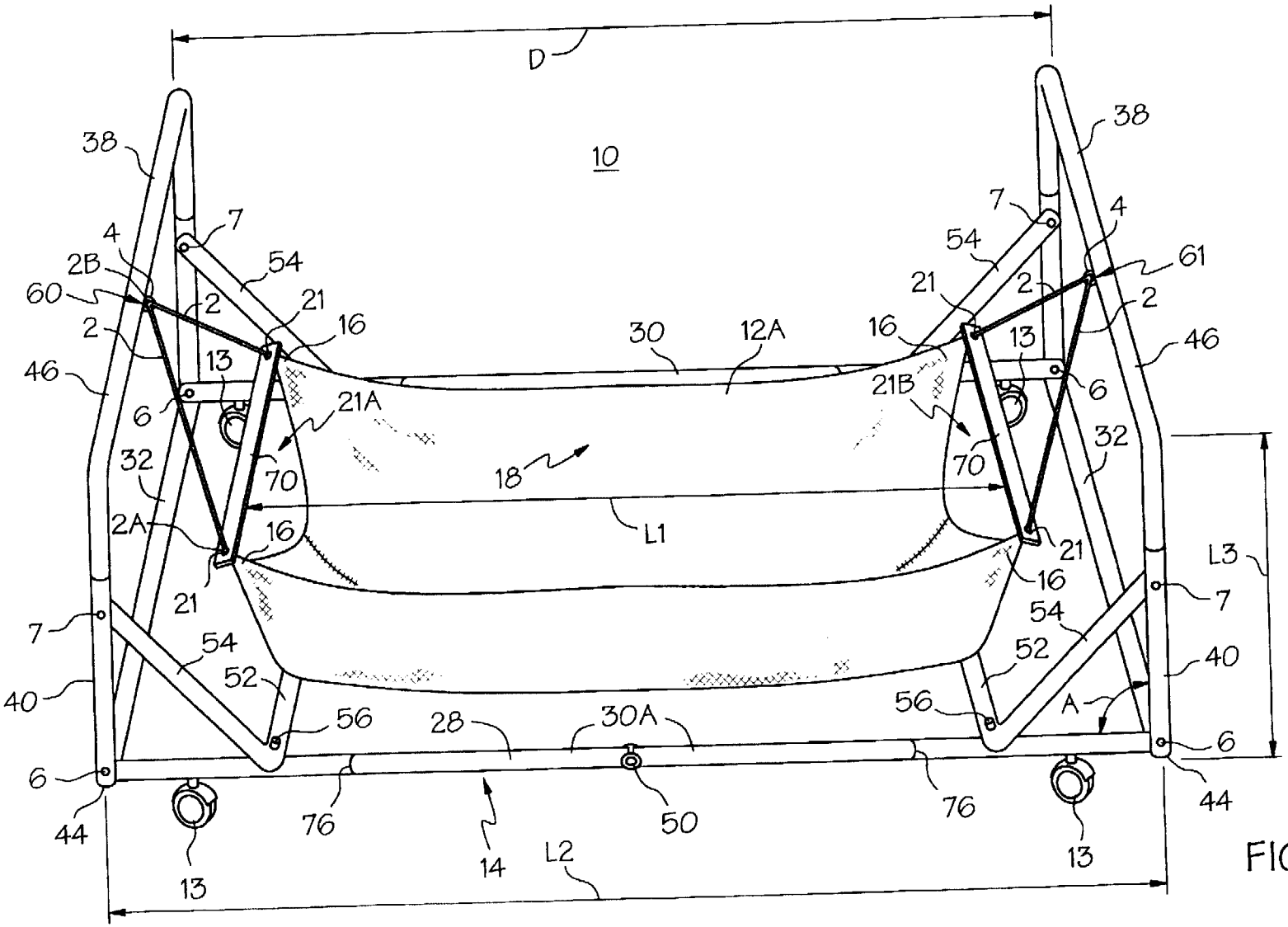
FIG. 2 is a perspective view of a "boat" shaped foldable cradle and frame assembly in accordance with a second exemplary embodiment of the present invention.

A first two of the lines 2 at the first cradle end 21A of the cradle 12 may be attached to a first position 60 on the frame 14 and a second two of the lines 2 at a second cradle end 21B of the cradle may be attached to a second position 61 on the frame such that the first and second positions are spaced apart a distance D (which is about a frame length L2 of the side members 30) greater than a cradle length L1 of the cradle. Spreading bars 70 for holding the top of the cradle 12 spread open may be disposed between each of the two lines 2 attached to each of the cradle ends 21A and 21B. Each line 2 is passed through a hole 21 of the spreader bar 70, then gathered and tied or otherwise attached to the loosely hanging ring 4 at the top center point of the cross members 46 of the frame end sections 38 so that the cradle will form a "boat" shape 12A as shown in FIG. 2 or a "U" shape as shown in FIG. 1 to accommodate the baby and allow the cradle 12 to swing from side to side using human or mechanical power. The cradle may have a spread out rectangular shape and may be made of a rectangular piece of cloth, plastic, or similar flexible material and the lines may be strings, ropes, or chains.

The frame 14 preferably includes side members that have telescopic means such as telescopic joint 76 for adjusting the frame length L2 of the side members 30. The frame end sections 38 also preferably have telescopic means for adjusting leg lengths L3 of the vertical legs 40. The frame also has swivel wheels 13 attached at four corners of base frame section 28 of the frame 14 for ease of movement.

It is to be understood that the form of the invention herewith shown and described is to be taken as a preferred embodiment. Various changes may be made in the shape, size and arrangement of parts, for example: equivalent elements may be substituted for those illustrated and described herein, parts may be reversed and certain features of the invention may be utilized independently of the use of other features all without departing from the spirit or scope of the invention as defined in the subjoining claims.

I claim:

1. A foldable cradle assembly comprising:

a cradle made of a flexible material, a foldable frame supporting said cradle, and an attachment means for attaching said cradle to said frame such that said flexible material hangs down freely from an open top of said cradle, said attachment means comprises line means having first line ends attached to said cradle and second line ends attached to said frame, said line means comprises four lines attached to four spaced apart corners of said cradle at said first line ends, wherein a first two of said lines are positioned at a first cradle end of said cradle attached to a first position on said frame and a second two of said lines are positioned at a second cradle end of said cradle attached to a second position on said frame wherein said first and second positions are spaced apart a distance greater than a cradle length of said cradle.

2. An assembly as claimed in claim 1, further comprising two spreading means for holding said top of said cradle spread open, each of said spreading means are disposed between each of said two lines attached to each of said cradle ends of said cradle.

3. An assembly as claimed in claim 2, wherein said cradle has a spread out rectangular shape.

4. An assembly as claimed in claim 3, wherein said lines are selected from a group of lines, said group of lines consisting of strings, ropes, and chains.

5. A foldable cradle assembly comprising:

a cradle made of a flexible material, a foldable frame supporting said cradle, and an attachment means for attaching said cradle to said frame such that said flexible material hangs down freely from an open top of said cradle, and wherein said frame further comprises;

a rectangular base frame section comprising spaced apart first and second frame side members fixedly attached at opposite frame ends of said frame to first and second end members of said base frame, two C shaped frame end sections each of which includes vertical legs pivotally attached to said base frame section at an opposite one of said frame ends, and said attachment menas supports said cradle from width wise extending cross members of said fram end sections.

6. An assembly as claimed in claim 5, wherein said first and second frame side members have hinged side sections that are pivotable through only 180 degrees with respect to each other.

7. An assembly as claimed in claim 6, wherein said frame further comprises two C shaped bracing members, each of which is pivotally attached to one of said two frame side members and said two end sections and removably secured by a securing means to an other of said two frame side members and said two end sections.

8. An assembly as claimed in claim 7, wherein said securing means is a screw.

9. An assembly as claimed in claim 6, wherein said frame side members have telescopic means for adjusting a frame length of said side members.

10. An assembly as claimed in claim 9, wherein said frame end sections have telescopic means for adjusting leg lengths of said vertical legs.

11. An assembly as claimed in claim 10, wherein attachment means comprises line means having first line ends attached to said cradle and second line ends attached to said frame.

12. An assembly as claimed in claim 11, wherein said line means comprises four lines attached to four spaced apart corners of said cradle at said first line ends.

13. An assembly as claimed in claim 12, wherein said line means further comprises a first two of said lines at a first cradle end of said cradle attached to a first position on said frame and a second two of said lines at a second cradle end of said cradle attached to a second position on said frame wherein said first and second positions are spaced apart a distance greater than a cradle length of said cradle.

14. An assembly as claimed in claim 13, further comprising two spreading means for holding said top of said cradle spread open, each of said spreading means are disposed between each of said two lines attached to each of said cradle ends of said cradle.

15. An assembly as claimed in claim 14, wherein said cradle has a boat shape.

16. An assembly as claimed in claim 15, wherein said lines are selected from a group of lines, said group of lines consisting of strings, ropes, and chains.

17. An assembly as claimed in claim 16, further comprising swivel wheels attached at four corners of said base frame section.

* * * * *